United States Patent [19]

Horodysky et al.

[11] Patent Number: 4,786,425

[45] **Date of Patent: * Nov. 22, 1988**

[54] ADDITIVE FOR LUBRICANTS AND HYDROCARBON FUELS COMPRISING REACTION PRODUCTS OF OLEFINS, SULFUR, HYDROGEN SULFIDE AND POLYMERIC SUCCINIMIDE COMPOUNDS

[75] Inventors: Andrew G. Horodysky, Cherry Hill; Derek A. Law, Pitman, both of N.J.

[73] Assignee: Mobil Oil Corporation, New York, N.Y.

[ * ] Notice: The portion of the term of this patent subsequent to Apr. 28, 2004 has been disclaimed.

[21] Appl. No.: 42,142

[22] Filed: Apr. 24, 1987

Related U.S. Application Data

[63] Continuation-in-part of Ser. No. 818,313, Jan. 13, 1986, Pat. No. 4,661,274.

[51] Int. Cl.[4] ..... C10M 135/04; C10M 133/16

[52] U.S. Cl. ..... 252/47; 252/47.5; 252/51.5 A

[58] Field of Search ..... 252/47, 51.5 A

[56] References Cited

U.S. PATENT DOCUMENTS

| | | | |
|---|---|---|---|
| 3,390,086 | 6/1968 | O-Halloran | 44/71 |
| 3,401,118 | 9/1968 | Benoit, Jr. | 252/32.7 E |
| 3,600,327 | 8/1971 | Hu | 252/47 |
| 3,664,955 | 5/1972 | Panzer | 252/47.5 |
| 3,703,504 | 11/1972 | Horodysky | 260/139 |
| 4,320,017 | 3/1982 | Spence | 252/47 |
| 4,661,274 | 4/1987 | Horodysky | 252/47 |

OTHER PUBLICATIONS

Rollins, 1987, "PTO Practice: 'Same Invention' Double Patenting", 69JPTOS 219-223.

*Primary Examiner*—William R. Dixon, Jr.
*Assistant Examiner*—Ellen McAvoy
*Attorney, Agent, or Firm*—Alexander J. McKillop; Michael G. Gilman; Van D. Harrison, Jr.

[57] ABSTRACT

Disclosed is an additive composition for lubricants and hydrocarbon fuel compositions formed by reacting an olefin, elemental sulfur, hydrogen sulfide, and a polymeric succinimide compound. The reaction product is effective when mixed in desired proportions with lubricants and with hydrocarbon fuels.

18 Claims, No Drawings

ADDITIVE FOR LUBRICANTS AND HYDROCARBON FUELS COMPRISING REACTION PRODUCTS OF OLEFINS, SULFUR, HYDROGEN SULFIDE AND POLYMERIC SUCCINIMIDE COMPOUNDS

CROSS REFERENCE TO RELATED PATENTS

This is a continuation-in-part of our copending application, Ser. No. 818,313, filed Jan. 13, 1986 now U.S. Pat. No. 4,661,274.

FIELD OF THE INVENTION

This application is directed to extreme pressure and antiwear additives for lubricants and fuels.

DISCUSSION OF THE PRIOR ART

U.S. Pat. No. 3,390,086 discloses the reaction of polyalkylene succinimides with elemental sulfur to provide lube oil dispersants.

U.S. Pat. No. 3,401,118 discloses the preparation of alkenyl succinimides by reacting high molecular weight polyisobutenyl succinic anhydride with tetraethylene pentamine and subsequently reacting this product with low molecular weight polyisobutenyl succinic anhydride.

U.S. Pat. No. 3,676,346 discloses a mixture of sulfurized pour point depressants and condensation products of polyalkylene polyamines with alkenyl succinic anhydride.

U.S. Pat. No. 3,703,504 discloses a process which comprises sulfohalogenating an olefin with a sulfur halide in the presence of a catalytic quantity of a lower aliphatic alcohol to form a sulfohalogenated organic intermediate, and thereafter sulfurizing and dehalogenating said intermediate in the presence of a substantial quantity of a lower aliphatic alcohol by treatment with an aqueous alkali metal monosulfide solution derived from a spent aqueous alkali metal hydroxide effluent from hydrocarbon purification and having a substantial combined sulfur content in producing an organic sulfide of high combined sulfur content.

SUMMARY OF THE INVENTION

This invention is directed in one aspect to an improved process for making extreme pressure (EP) and antiwear additives for lubricants and fuels. The process in brief comprises reacting an olefin, elemental sulfur, hydrogen sulfide, and a polymeric nitrogen-containing compound optionally containing a small amount or catalytic amount of an amine. In another aspect this invention comprises the additive compositions produced by this process. In still another aspect this invention comprises the process for making lubricant and fuel compositions by adding to said lubricant or fuel an effective amount of the additive material. In still another aspect this invention comprises the lubricant and fuel compositions so made.

DESCRIPTION OF SPECIFIC EMBODIMENTS

As noted above, one aspect of this invention comprises the process for making the additive material of improved performance and improved odor wherein there is a co-reaction between an olefin, elemental sulfur, hydrogen sulfide, and a polymeric nitrogen-containing compound containing an effective amount of an amine.

The olefin reactant preferably is a monoolefin and preferably is isobutylene but can also comprise other butenes, propylenes, pentenes and mixtures of the foregoing.

The sulfur reactant is supplied to the reaction mixture preferably in a powdered or a ground elemental form and should have a commercial grade of purity.

The hydrogen sulfide is added to the reaction mixture in the form of a gas preferably but may be admitted to the reaction mixture, if the reactor pressure is sufficient, in a liquid form.

The nitrogen-containing polymeric material preferably is selected from the group consisting of succinimides, amides, imides, esters containing nitrogen atoms, polyoxazoline and imidazoline compounds. Other preferred nitrogen-containing polymeric materials include the reaction products of polyisobutenyl succinic anhydrides, and carboxylic acids, or dicarboxylic acids or their corresponding anhydrides with:

(a) polyethylene amines such as diethylenetriamine, triethylenetetramine, or tetraethylenepentamine;

(b) polyols such as pentaerythritol, trimethylol propane in conjunction with (a) preceding or (c) following; and (c) hydroxyl-containing amines such as tris(hydroxymethyl)aminomethane.

The molecular weight of the polymeric material should be at least 500–50,000, and preferably 1,000 to 5,000.

The polyoxazoline polymers are well known materials. Poly(2-substituted-2-oxazoline) polymers are available from Dow Chemical Company, Midland, Mich. Poly(2-ethyl-2-oxazoline) designated PEOX 425 (Dow) is used in the examples which follow and has been found particularly useful.

The alkyl imidazoline compounds, also well known, can be prepared by reacting one mole of hydroxyethylethylene diamine with an appropriate organic acid, such as naphthenic or decanoic acid. Such a preparation is described in U.S. Pat. No. 4,440,658, which is incorporated herein by reference.

Of all these materials the most preferred are the polymeric succinimides, particularly the polyisobutenyl succinimides. A polyisobutenyl succinimide useful in this invention is the reaction product of a polyisobutenyl succinic anhydride (made by the co-reaction of polyisobutylene of 900 molecular weight with maleic anhydride) with tetraethylene pentamine.

The nitrogen-containing polymeric material can also be selected from the group consisting of polymeric esters, polymer ester/amides and/or borated derivatives as the fourth co-reactant to form improved and novel products. Included are: "carboxylic dispersants" such as those described in U.S. Pat. Nos. 3,163,603, 3,184,374, 3,215,707, 3,316,177, 3,340,281, 3,341,547, 3,632,510, 3,632,511, 3,697,428, 3,725,441, or amine dispersants such as those described in U.S. Pat. Nos. 3,413,347, 3,697,574, 3,725,277, 3,725,480, 3,726,882 or any of above post-treated with boron compounds, epoxides, urea, etc., such as those in U.S. Pat. Nos. 3,702,757, 3,702,536, 3,704,308, and 3,708,522. The patents itemized in this paragraph are incorporated by reference. Omission of the above polymeric amines forms a product with higher objectionable odor level.

The reaction, preferably, is carried out by the direct reaction of the olefin, sulfur, hydrogen sulfide and polymeric succinimide at temperatures from 130° C. to 200° C. for periods of between 2 and 24 hours at pressures from atmospheric up to about 900 psig. The preferred ratios between the reactants is between 3 and 0.5 moles of olefin, 0.001 and 0.4 moles of succinimide, and 0.5 to 0.7 (preferably 0.6) moles of hydrogen sulfides, each to 1 mole of sulfur. The optional amount of catalytic amines present should be that amount required to catalyze the reaction. The amine can be chosen from the aliphatic amines such as propyl amine or butyl amine. After reaction is complete the product is vacuum topped, or nitrogen sparged and is then filtered to yield the desired reaction product composition. The reaction product thus obtained is believed to be a mixture of compounds, the mixture working to provide improved thermal and oxidative stability and improved lubricity properties when added in effective amounts to a lubricant composition or hydrocarbon fuel. Ordinarily effective amounts will be in the range of 2 to 500 pounds per 1000 barrels of hydrocarbon material. It will also be understood that the resulting fuel and lubricant compositions will contain other additive materials for other purposes in the compositions. Other additives can include detergents, antioxidants, pour depressants, auxiliary EP/antiwear additives, color stabilizers, antifoam agents and the like.

It will be noted that in the process of reacting the above listed materials there should be a certain amount of free polymer amine in the nitrogen-containing polymer material used as a co-reactant. This amine is required to function as a reactant. Ordinarily there will be some free amine present in the products commercially available. Ordinarily a concentration of between 0.5 and 10 percent of the total weight of reactants of amine will be desirable. Suitable amines include, but not exclusively, reaction products of polyisobutenylsuccinic anhydride with polyethylene amines such as diethylenetriamine, triethylenetetramine, tetraethylenepentamine and hydroxyl containing amines such as tris(hydroxymethyl)aminomethane.

EXAMPLE 1

Approximately 408 grams of sulfur, 4 grams of polyisobutenyl succinimide containing free amine, 601 grams of isobutylene, and 142 grams of hydrogen sulfide were charged to a stainless steel reactor purged with nitrogen and equipped with a heater, cooler and agitator. The reactants were heated at approximately 160° to 165° C. until the pressure, which reached a maximum of about 700 psig during the early stages of the reaction, dropped to well below 40 psig indicating completion of the reaction. The reaction time was approximately 10 hours. The crude product was then sparged at about 100° C. with nitrogen for about 10 hours to remove small amounts of volatiles. The crude product was an amber colored, low viscosity fluid with low odor, which was then filtered through a bed of diatomaceous earth. The product when analyzed contained approximately 45.5 percent sulfur.

EXAMPLE 2

Approximately 408 grams of sulfur, 58 grams of polyisobutenyl succinimide containing free amine, 601 grams of isobutylene, and 142 grams of hydrogen sulfide were charged to a stainless steel reactor equipped as generally described in Example 1. The reactants were heated at approximately 160° to 165° C. and a pressure maximum was noted similar to that described in Example 1. During the latter stages of the approximate 12-hour reaction period, the pressure dropped to well below 40 psig and leveled off, indicating completion of the reaction. The crude product was then sparged at about 100° C. with nitrogen for approximately two hours to remove small amounts of volatiles. The crude product was an amber colored, low viscosity fluid with low odor which was filtered through a bed of diatomaceous earth. The product when analyzed contained approximately 46.9 percent sulfur.

The products of Examples 1 and 2 were blended into fully formulated automotive gear oil packages and evaluated for copper strip corrosivity. Results of the tests are shown in Table 1.

TABLE 1

COPPER STRIP CORROSIVITY TEST BASED ON ASTM D 130-80

| | Concentration of Sulfurized Olefin in Fully Formulated Automotive Gear Oil Formulation, Wt. % | Corrosivity Rating |
|---|---|---|
| Example 1 | 3.0 | 2B |
| Example 2 | 3.0 | 1B |
| Product Produced by the Process of U.S. Pat. No. 3,703,504 | 3.4 | 2A |
| | 3.0 | 2B |

The products of Examples 1 and 2 were blended into fully formulated automotive gear oil formulations containing inhibitors, antirust and anticorrosion/antistaining additives and evaluated for EP/antiwear properties using the CRC-L-42 gear test. As can be seen from Table 2, formulations containing 3.0 percent of the products of Examples 1 and 2 passed the scoring test. Equivalent 3.0 percent concentrations and even higher concentrations of 3.2 and 3.4 percent of the product of U.S. Pat. No. 3,703,504 (sulfurized isobutylenes) failed the identical scoring test with as much as 30–35 percent scoring compared to Examples 1 and 2 which show only 3 to 5 percent scoring.

TABLE 2

CRC L-42 GEAR WEAR TEST

| | Concentration of Sulfurized Olefin in Fully Formulated Automotive Gear Oil Formulation, Wt. % | L-42 Rating |
|---|---|---|
| Example 1 | 3.0 | Pass (3% scoring) |
| Example 2 | 3.0 | Pass (5% scoring) |
| Product Produced by the Process of U.S. Pat. No. 3,703,504 | 3.4 | Fail (15% scoring) |
| | 3.2 | Fail (20–25% |
| | 3.0 | Fail (30–35% scoring) |

The products of the examples were evaluated for odor and were found to be significantly improved when compared to the product of Example 1 of U.S. Pat. No. 4,344,854, made in a manner analogous to the examples of this application but without the use of the above-described polymeric amine as a co-reactant.

What is claimed is:

1. A process for making an additive for lubricants comprising co-reacting:

(a) an olefin (b) sulfur (c) hydrogen sulfide; and (d) a polymeric succinimide selected from the group consisting of the reaction products of polymeric succinic anhydride with one or more reactants selected from the group consisting of:

(a) polyethylene amines selected from the group consisting of diethylene triamines, triethylenetetramine, and tetraethylenepentamine;

(b) hydroxyl containing amines, and;

(c) polyols in conjunction with (a) or (b) selected from the group consisting of pentaerythritol, and trimethylol propane at a temperature between about 130° C. and about 200° C. and a pressure of about 0 psig to about 900 psig, the reactants being reacted in a molar ratio of olefin, polymeric succinimide, and hydrogen sulfide to sulfur of about 3 to about 0.5, about 0.001, to about 0.4, and about 0.5 to about 0.7, respectively.

2. The process of claim 1 wherein the reactants are reacted at a temperature of about 130° C. to about 200° C. and a pressure of about 0 psig to about 900 psig.

3. The process of claim 1 wherein the reactants are reacted in a molar ratio of olefin, succinimide, and hydrogen sulfide to sulfur of 2 to 0.5, 0.001 to 0.4, and 0.5 to 0.7 respectively.

4. The process of claim 1 wherein said olefin is a monoolefin selected from the group consisting of butylenes, propylenes, pentenes and mixtures thereof.

5. The process of claim 1 wherein said olefin is isobutylene.

6. The product produced by the process of claim 1.

7. The product produced by the process of claim 2, 3, 4, or 5.

8. A process for making a hydrocarbon lubricant comprising adding to said hydrocarbon lubricant the product produced by the process of claim 1.

9. The hydrocarbon lubricant produced by adding to a hydrocarbon lubricant the product produced by the process of claim 1.

10. A process for making an additive for lubricants comprising co-reacting:

(a) an olefin (b) sulfur (c) hydrogen sulfide; and (d) a polymeric succinimide selected from the group consisting of the reaction product of polyisobutenylsuccinic anhydride with one of more reactants selected from the group consisting of:

(a) polyethylene amines selected from the group consisting of diethylene triamine, triethylenetetramine, and tetraethylenepentamine;

(b) hydroxyl containing amines, and;

(c) polyols in conjunction with (a) or (b) selected from the group consisting of pentaerythritol, and trimethylol propane at a temperature between about 130° C. and about 200° C. and a pressure of about 0 psig to about 900 psig, the reactants being reacted in a molar ratio of olefin, polymeric succinimide, and hydrogen sulfide to sulfur of about 3 to about 0.5, about 0.001, to about 0.4, and about 0.5 to about 0.7, respectively.

11. The process of claim 10 wherein the reactants are reacted at a temperature of about 130° C. to about 200° C. and a pressure of about 0 psig to about 900 psig.

12. The process of claim 10 wherein the reactants are reacted in a molar ratio of olefin, succinimide, and hydrogen sulfide to sulfur of 2 to 0.5, 0.001 to 0.4, and 0.5 to 0.7 respectively.

13. The process of claim 10 wherein said olefin is a monoolefin selected from the group consisting of butylenes, propylenes, pentenes and mixtures thereof.

14. The process of claim 10 wherein said olefin is isobutylene.

15. The product produced by the process of claim 10.

16. The product produced by the process of claim 11, 12, 13, or 14.

17. A process for making a hydrocarbon lubricant comprising adding to said hydrocarbon lubricant the product produced by the process of claim 10.

18. The hydrocarbon lubricant produced by adding to a hydrocarbon lubricant the product produced by the process of claim 10.

* * * * *